US008397835B1

(12) United States Patent
Lyngaas

(10) Patent No.: US 8,397,835 B1
(45) Date of Patent: Mar. 19, 2013

(54) ICE AUGER ATTACHMENT FOR A VEHICLE

(76) Inventor: James L. Lyngaas, Campbell, MN (US)

( * ) Notice: Subject to any disclaimer, the term of this patent is extended or adjusted under 35 U.S.C. 154(b) by 301 days.

(21) Appl. No.: 12/898,852

(22) Filed: Oct. 6, 2010

(51) Int. Cl.
*E21B 3/02* (2006.01)

(52) U.S. Cl. ..... 175/18; 299/24

(58) Field of Classification Search ..... 175/18; 299/24
See application file for complete search history.

(56) References Cited

U.S. PATENT DOCUMENTS

| | | | | |
|---|---|---|---|---|
| 2,474,981 | A | 7/1949 | McCardell | |
| 2,562,276 | A | 7/1951 | Kandle | |
| 2,774,568 | A | 12/1956 | Jones | |
| 3,367,427 | A | 2/1968 | Baumgardner | |
| 3,700,045 | A | 10/1972 | Coontz | |
| 5,363,925 | A | 11/1994 | Gallagher | |
| 5,542,476 | A | 8/1996 | Hansen | |
| 5,836,402 | A * | 11/1998 | Jones | 173/185 |
| 6,675,916 | B1 | 1/2004 | Mathews | |
| 6,681,470 | B1 | 1/2004 | Scott | |
| 6,889,779 | B2 | 5/2005 | Skarlupka, IV | |
| 2004/0195285 | A1 * | 10/2004 | Pinard | 224/510 |
| 2010/0224746 | A1 * | 9/2010 | Johnson et al. | 248/205.1 |

* cited by examiner

*Primary Examiner* — William P Neuder
(74) *Attorney, Agent, or Firm* — Neustel Law Offices

(57) ABSTRACT

An ice auger attachment for attaching an ice auger to and operating the ice auger from a vehicle, such as an ATV. The ice auger attachment generally includes a support frame attached to a front end of the vehicle, a carriage assembly movable vertically along the support frame, and a motorized ice auger supported by the carriage assembly in a vertical orientation, the ice auger adapted to move vertically along the support frame with the carriage assembly. The carriage assembly and ice auger are generally raised and lowered via a winch, cable, and pulley operable from the seat of the vehicle. The ice auger may also be operated from the seat of the vehicle via a control unit that engages the motor of the ice auger. Various structures may be utilized to apply downward pressure structures upon the carriage assembly to ensure proper functioning of the ice auger.

19 Claims, 7 Drawing Sheets

ICE AUGER ATTACHMENT FOR A VEHICLE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an ice auger and more specifically it relates to an ice auger attachment for a vehicle for efficiently attaching a motorized ice auger to and operating the motorized ice auger from a vehicle, such as an ATV.

2. Description of the Related Art

Any discussion of the related art throughout the specification should in no way be considered as an admission that such related art is widely known or forms part of common general knowledge in the field.

Ice augers have been in use for years. Typically, when drilling ice holes, the operator must leave their vehicle to reach the desired ice hole location when operating the ice auger. While drilling completely through the ice, there is generally a rush of water that rises up through the hole and over the ice. Depending on the weight upon the ice and the manner in which the hole was drilled, the amount of water can be substantial and can often times cause the operator of the ice auger to become wet which can be extremely uncomfortable and dangerous, especially in the usual cold conditions associated with ice fishing and ice auger use.

Additionally, drilling ice holes can be dangerous in that the supporting surface which the operator stands upon is generally ice, thus increasing the chances that the operator will fall during operation of the ice auger and impact the ice or the ice auger. Because of the inherent problems with the related art, there is a need for a new and improved ice auger attachment for a vehicle for efficiently attaching a motorized ice auger to and operating the motorized ice auger from a vehicle, such as an ATV.

BRIEF SUMMARY OF THE INVENTION

A system for efficiently attaching a motorized ice auger to and operating the motorized ice auger from a vehicle, such as an ATV. The invention generally relates to an ice auger which includes a support frame attached to a front end of the vehicle, a carriage assembly movable vertically along the support frame, and a motorized ice auger supported by the carriage assembly in a vertical orientation, the ice auger adapted to move vertically along the support frame with the carriage assembly. The carriage assembly and ice auger are generally raised and lowered via a winch, cable, and pulley operable from the seat of the vehicle. The ice auger may also be operated from the seat of the vehicle via a control unit that engages the motor of the ice auger. Various structures may be utilized to apply downward pressure structures upon the carriage assembly to ensure proper functioning of the ice auger.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
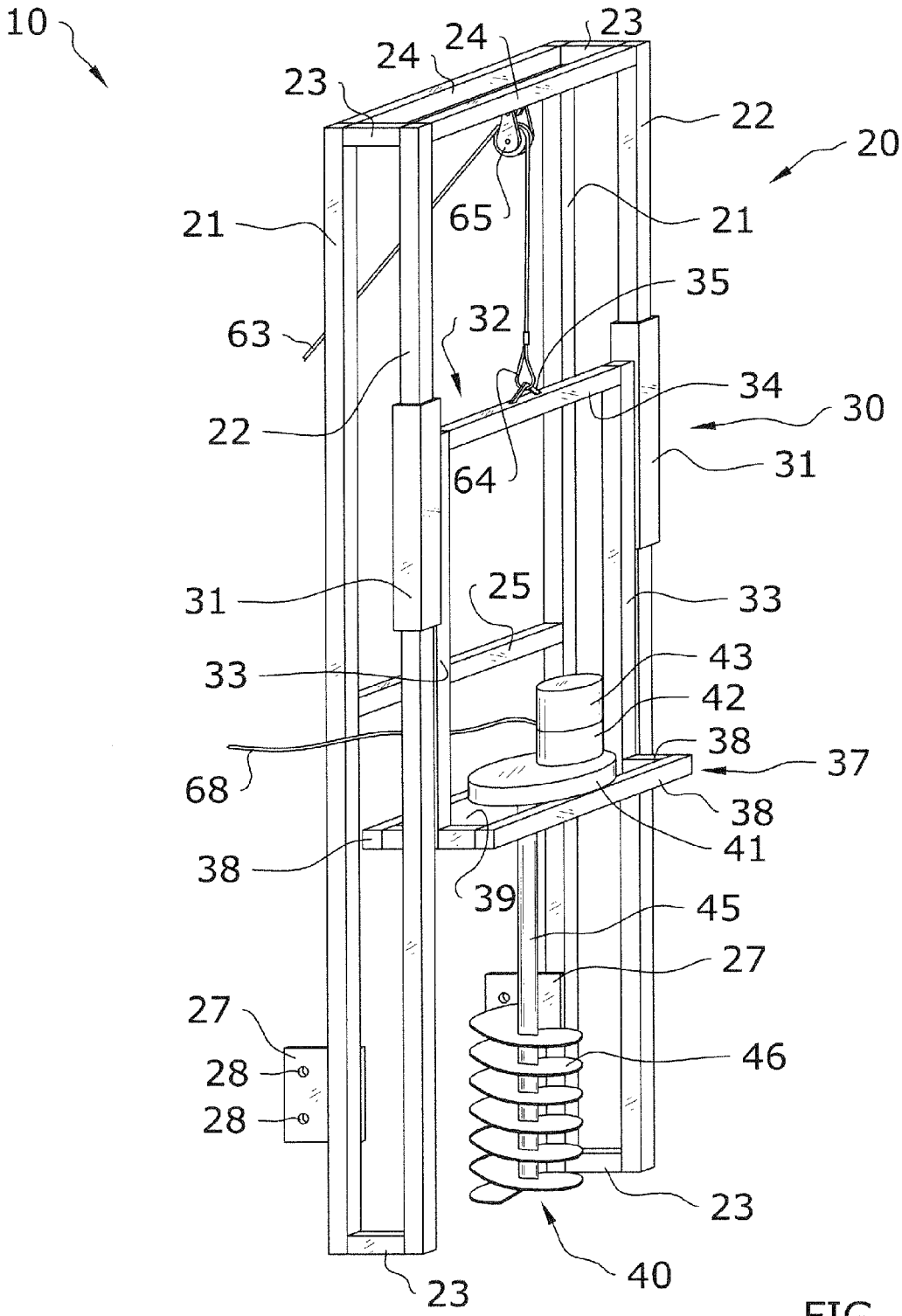
FIG. 1 is an upper perspective view of the present invention.
Figure 2:
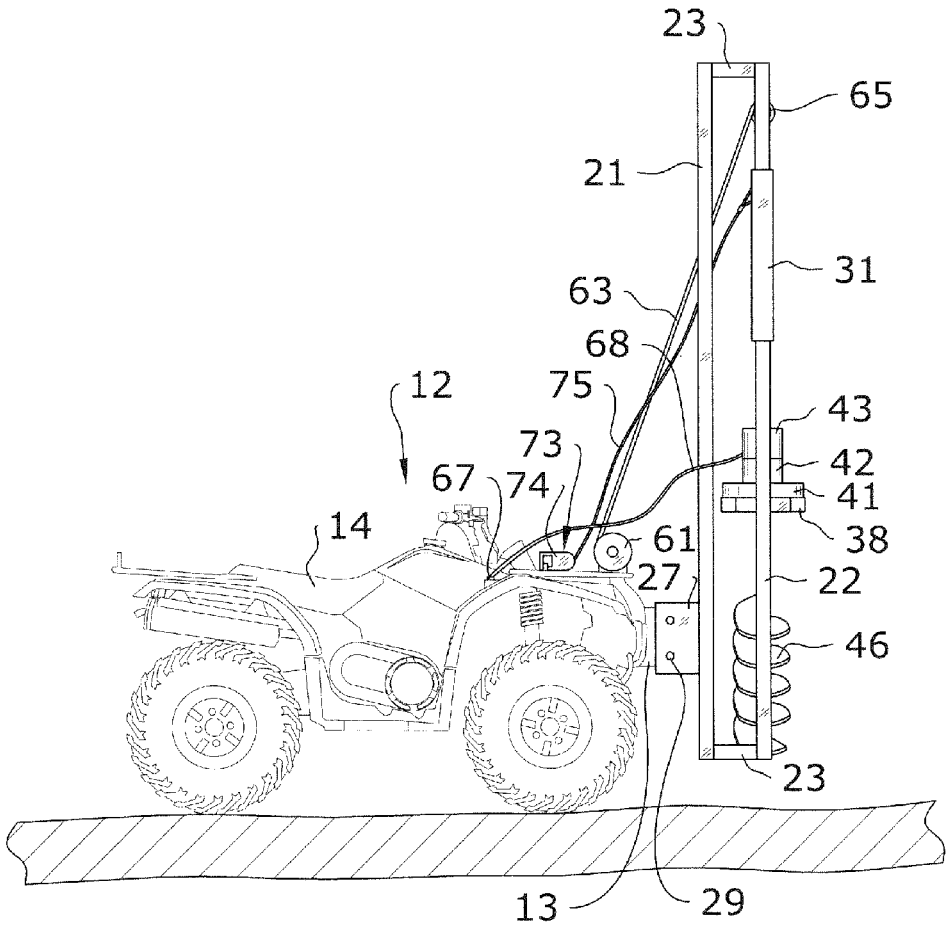
FIG. 2 is a side view of the present invention attached to a front end of the vehicle and the carriage assembly and ice auger in a raised position.
Figure 3:
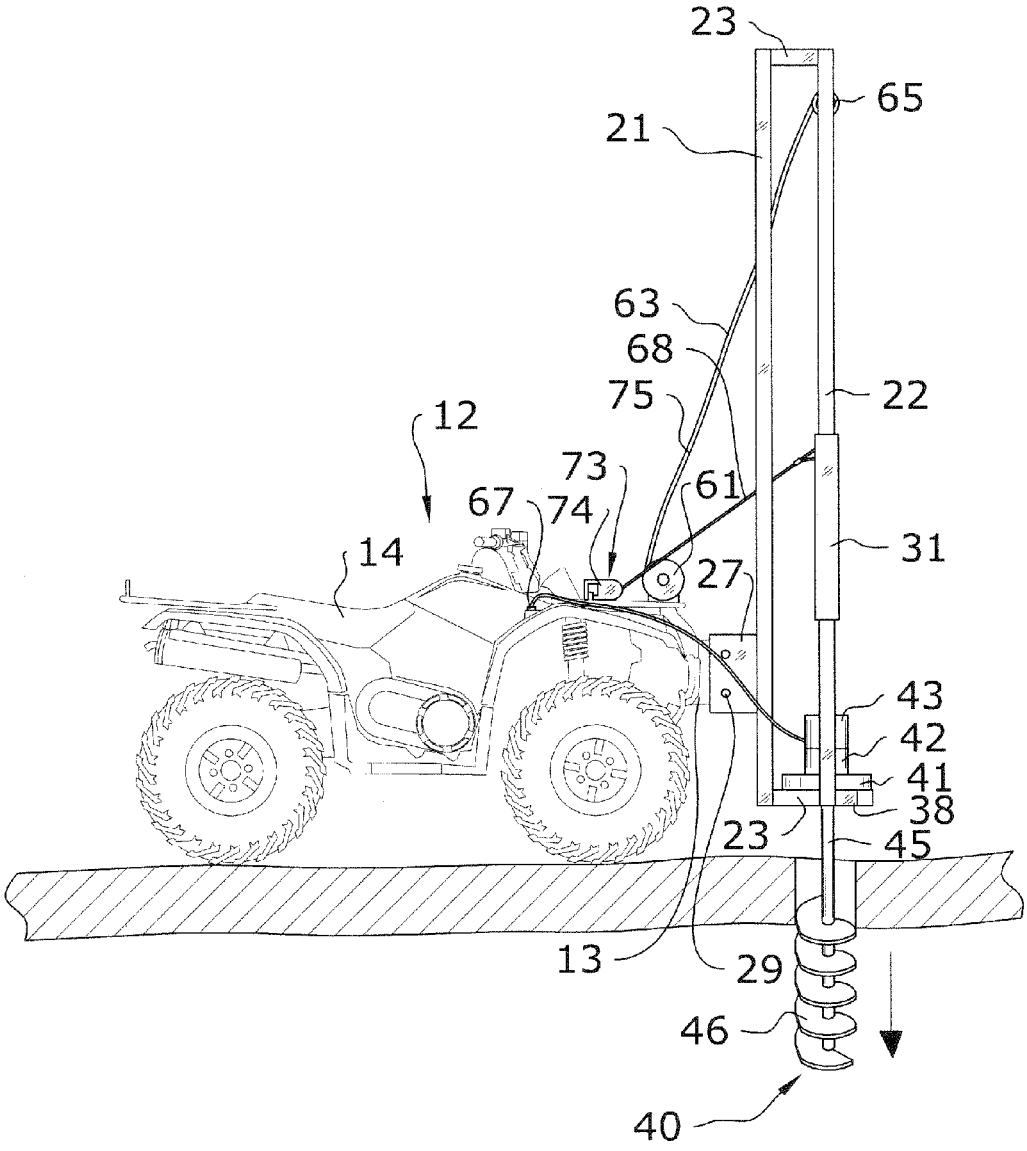
FIG. 3 is a side view of the present invention attached to a front end of the vehicle and the carriage assembly and ice auger in a lowered position.
Figure 4:
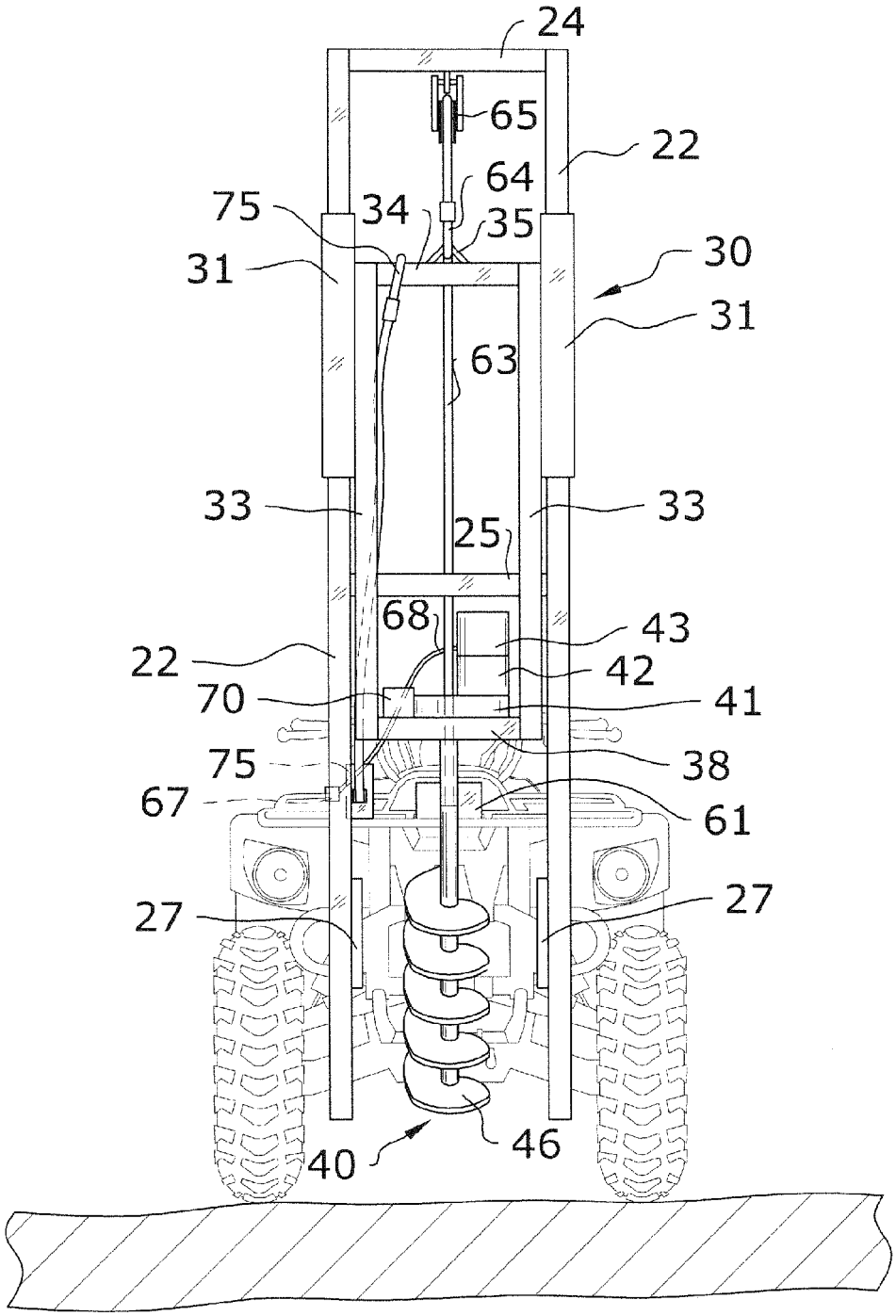
FIG. 4 is a front view of the present invention attached to a front end of the vehicle and the carriage assembly and ice auger in a raised position.
Figure 5:
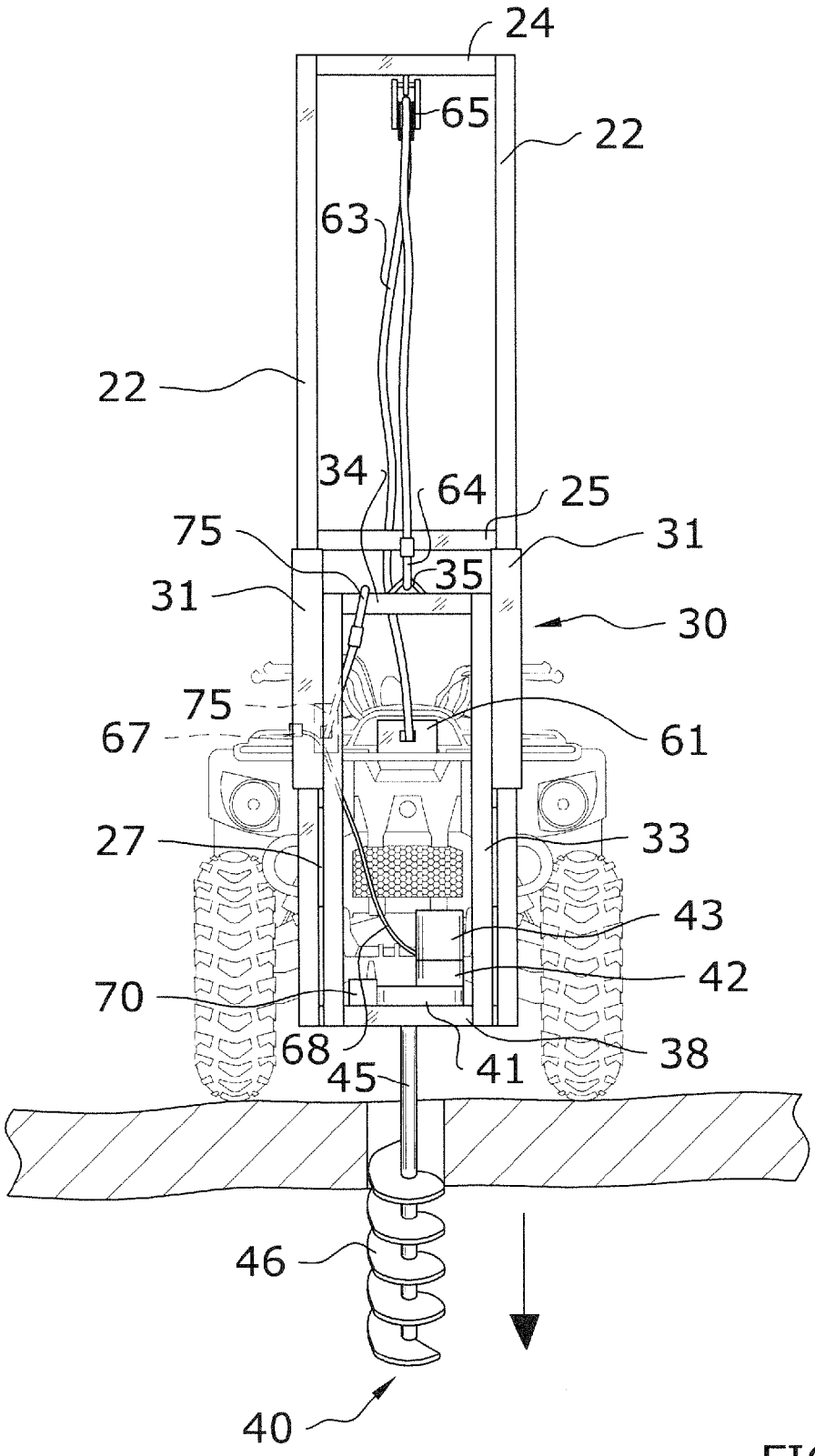
FIG. 5 is a front view of the present invention attached to a front end of the vehicle and the carriage assembly and ice auger in a lowered position.
Figure 6:
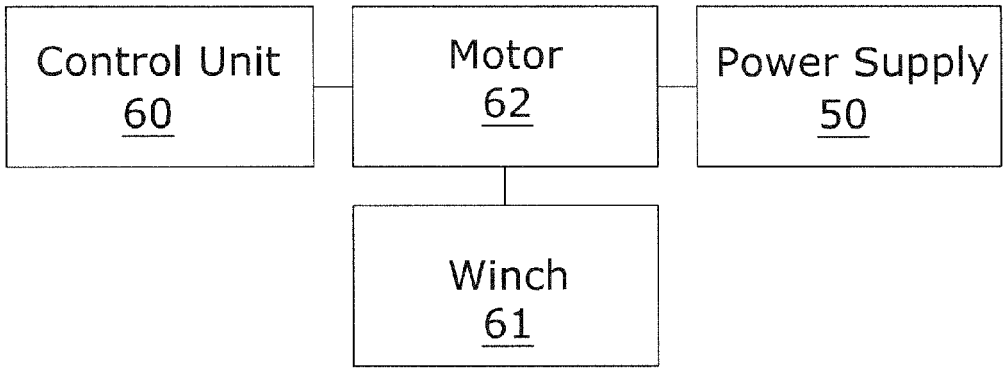
FIG. 6 is a block diagram of an exemplary connection of the first control unit to the motor of the winch.
Figure 7:
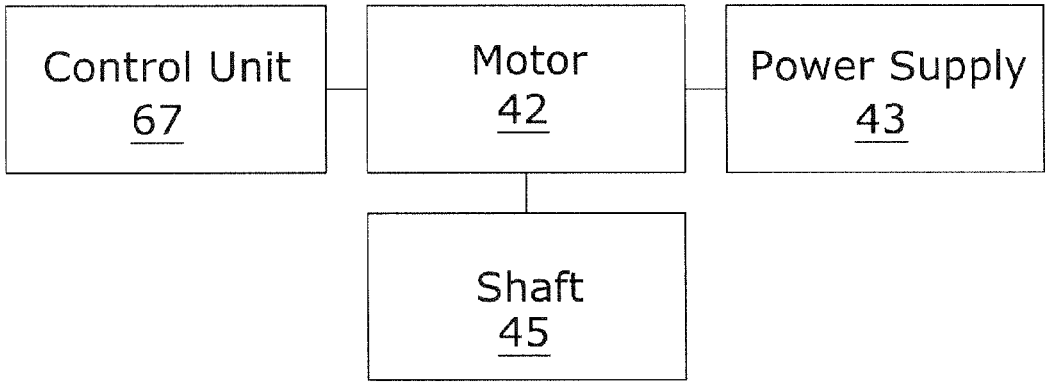
FIG. 7 is a block diagram of an exemplary connection of the second control unit to the motor of the auger.

Turning now descriptively to the drawings, in which similar reference characters denote similar elements throughout the several views, FIGS. 1 through 7 illustrate an ice auger attachment for a vehicle 10, which comprises a support frame 20 attached to a front end of the vehicle 12, a carriage assembly 30 movable vertically along the support frame 20, and a motorized ice auger 40 supported by the carriage assembly 30 in a vertical orientation, the ice auger 40 adapted to move vertically along the support frame 20 with the carriage assembly 30. The carriage assembly 30 and ice auger 40 are generally raised and lowered via a winch 61, cable 63, and pulley 65 operable from the seat 14 of the vehicle 12. The ice auger 40 may also be operated from the seat 14 of the vehicle 12 via a control unit 67 that engages the motor 42 of the ice auger 40. Various structures may be utilized to apply downward pressure structures upon the carriage assembly 30 to ensure proper functioning of the ice auger 40, such as weighted members 70 or retractable unit 73.

B. Vehicle

Various types of vehicles 12 may be used to support the ice auger 40 attachment 10. Preferably the vehicle 12 is able to maneuver upon a sheet of ice 16, wherein the vehicle 12 is able to drive directly to the location in which the hole 17 is to be drilled through the ice 16. The vehicle 12 is also of a suitable means for supporting the frame 20 in a vertical manner. Generally an all-terrain vehicle (ATV) is utilized; however various types of other vehicles may be utilized as appreciated.

C. Support Frame

The support frame 20 is generally comprised of a rigid and strong structure, such as via a metal material. The support frame 20 is supported in a vertical orientation by the vehicle 12 and is generally connected to the front end of a vehicle 12 by attaching a bracket 27 extending from the lower end of the rear of the support frame 20 to a front support 13 of the vehicle 12. The front support 13 of the vehicle 12 may be comprised of a front grill support or various other structures.

The bracket 27 may be secured thereto with various types of fasteners 29, in pre-existing mounting locations or newly-installed mounting locations. It is also appreciated that in alternate embodiments, the bracket 27 may secure the support frame 20 to the rear end of the vehicle 12; however the front end of the vehicle 12 is preferred because it may generally be easier to maneuver the vehicle to a hole location and align the ice auger 40 over a hole location by driving forwardly with the vehicle 12 with the ice auger 40 positioned in front of the vehicle 12.

The support frame 20 generally includes a pair of vertically oriented rear supports 21 extending parallel to each other and generally forming the rear of the support frame 20. The rear supports 21 have the bracket 27 extending rearwardly from a lower end thereof to attach to the vehicle 12. The bracket 27 may have mounting holes 28 to receive fasteners 29, such as bolts, or have other means to fasten to the vehicle 12.

The support frame 20 also generally includes a pair of parallel front supports 22 serving as guides, also vertically oriented, and positioned in front of each of the rear supports 21. The front supports 22 are comprised of a straight and elongated structure so that the carriage assembly 30 may travel up and down the front supports 22 to extend the blades 46 of the ice auger 40 through the ice 16 and lift the entire ice auger 40 above the ice 16 so that the vehicle 12 may be driven in a conventional manner.

The support frame 20 also includes connecting members 23 to connect top and bottom ends of the rear supports 21 to the front supports 22 to stabilize the front supports 22 about the rear supports 21. Thus, the rear supports 21 are generally comprised of a similar height as the front supports 22. The support frame 20 also generally includes connecting members 24 connecting the top ends of the front supports 22 and connecting the top ends of the rear supports 21 to further stabilize the support frame 20. The support frame 20 may further include various braces to add stability, such as the illustrated center brace 25. It is appreciated that the bottom, below the front supports 22, is generally left open to allow passage of the ice auger 40.

D. Carriage Assembly

The carriage assembly 30 travels along the vertical axis of the support frame 20 and in particular the front supports 22 to move the ice auger 40 downward and upward during in-use and non-use periods. Like the support frame 20, the carriage assembly 30 is generally comprised of a rigid and strong structure, such as via a metal material.

The carriage assembly 30 generally includes a pair of receiver members 31 to collectively travel up and down the front supports 22 of the support frame 20. The receiver members 31 are each preferably comprised of a square-tubular and vertical oriented structure to correlate with the cross-sectional structure of the front supports 22 and to ensure that the receiver members 31 do not twist or bend while vertically travelling along the front supports 22.

Extending on an inward side of the receiver members 31 is an upper support structure 32 having a pair of vertical supports 33 that extend downwards from the receiver members 31 to connect to the lower support structure 37 that supports the ice auger 40. The vertical supports 33 are movable with the receiver members 31 along the front supports 22. The vertical supports 33 are generally connected at a top end via a horizontal support 34 extending therebetween, wherein the horizontal support 34 preferably has a looped connector 35 extending from a top end for connecting to the elongated member 63 for lifting and lowering the carriage assembly 30.

The lower support structure 37 is supported in a horizontal plane at a lower end of the vertical supports 33 for supporting the head 41 of the ice auger 40 and allowing the shaft 45 and blades 46 of the ice auger 40 to extend below. The lower support structure 37 is positioned between the front supports 22 and is generally comprised of a plurality of support members 38 forming a square shaped structure and having an opening 39 extending therebetween for receiving the ice auger 40. It is appreciated that the lower support structure 37 may be comprised of various alternate structures all which are suitable for holding and securing the ice auger 40 in a stable manner and vertical orientation. The ice auger 40 may be secured to the lower support structure 37 in various manners as appreciated.

E. Motorized Ice Auger

The ice auger 40 is preferably motorized and may be powered through various means, such as via an electric motor, gasoline motor, etc. and thus have various power supplies 43, such as a battery or fuel tank. The ice auger 40 includes a head 41 having the motor 42 and power supply 43 thereon and a rotatably driven shaft 45 extending downward from the head 41 having an auger blade 46 circling the shaft 45 for being rotated to drill through the ice 16 in a manner conventional with powered ice augers 40. The head 41 is generally supported above the lower support structure 37 of the carriage assembly 30 and the shaft 45 and blades 46 generally extend below the lower support structure 37, thus the lower support structure 37 preventing the head 41 and motor from engaging the ice 16 or rising water when drilling the hole 17.

F. Lifting/Lowering Means

The present invention may include various lifting and lowering means for lifting and lowering the carriage assembly 30 and supported ice auger 40. The lifting and lowering means is preferably operable from the seat 14 of the vehicle 12 to allow the operator to lower the ice auger 40 to drill the hole 17 through the ice 16 and lift the ice auger 40 out of the hole 17 thus being able to drive the vehicle 12 with the ice auger 40 attached and lifted.

A preferred embodiment of the lifting and lowering means comprises a winch 61 mounted to the vehicle 12 and powered via a power supply 50. The power supply 50 may be the conventional vehicle power supply 50, such as the vehicle battery, or may be an auxiliary power supply. Thus, the winch 61 generally has an electric motor 62; however various other types may be utilized, such as manually powered via a crank, etc.

A retractable elongated member 63, such as a rope, cable, strap, etc. retractably extends from the winch 61 through a pulley 65, generally located at the upper end of the support frame 20 connected to the front connecting member 24 thus being directly above the horizontal support 34, and terminating at a terminal end 64 connected to the looped connector 35 of the horizontal support 34 of the carriage assembly 30. Various fasteners, hooks, etc. may be used at the terminal end 64 of the elongated member 63 to connect or removably connect to the looped connector 35 as appreciated. A control unit 60 used to activate the motor 62 and winch 61 is generally operable from the seat 14 of the vehicle 12. Various types of control units 60 may be utilized, such as common winch switches, etc.

G. Motor Engaging Means

The present invention also includes a motor engaging means to engage the motor 42 of the ice auger 40 for rotating the shaft 45 and blades 46 to drill holes 17 in the ice 16. The motor engaging means is preferably operable from the seat 14 of the vehicle 12 to allow the operator to engage the ice auger 40 to drill the hole 17 through the ice 16 without having to dismount from the vehicle 12.

A preferred embodiment of the motor engaging means is a control unit 67, such as a common winch switch, that has a transmission cable 68 extending therefrom, such as an electrical cable or other type of transmission cable, which is attached to the motor 42 or power supply 43 of the ice auger 40. In an electrically powered embodiment of the motor 42 of the ice auger 40, the control unit 67 simply activates the motor 42 of the ice auger 40 to start drawing power from an onboard power supply 43 of the electrically powered ice auger 40. The motor 42 of the ice auger 40 may be engaged to rotate the blades 46 and shaft 45 in a clockwise and/or counterclockwise direction via the control unit 67. Alternately, the control unit 67 may electrically connect the power supply 50 of the vehicle 12 to the electric motor 42 of the ice auger 40. In another alternate configuration, the control unit 67 may engage a gasoline powered motor of the ice auger 40.

H. Downward Pressure Structures

The present invention may include various downward pressure structures for applying downward pressure upon the carriage assembly 30 to ensure that the ice auger 40 continually moves downward when drilling through the ice 16. A first type of downward pressure structure may be simply comprised of weighted members 70 supported by the carriage assembly 30. The weighted members 70 apply additional poundage and downward force to the carriage assemblies by increasing the weight of the carriage assembly 30. It is appreciated that the weighted members 70 may be made integral with the carriage assembly 30 and/or a heavier carriage assembly 30 may be assembled.

Another type of downward pressure structure comprises a retractable unit 73 operable by the user to selectively apply downward pulling force upon the carriage assembly 30. The retractable unit 73 is comprised of a similar structure as a retractable dog leash and generally includes a housing 74 having a retracting mechanism (not shown) and trigger (not shown) to operate a retractable elongated member 75 connected on a terminating end to varying points upon the carriage assembly 30.

When downward pressure is desired to be applied to the carriage assembly 30, the retractable unit 73 is engaged to retract the elongated member 75 which pulls downward upon the carriage assembly 30 and thus ice auger 40. The elongated member 75 is generally attached to the upper end of the upper support structure 32 and extends directly downwards to the vehicle 12 to apply the downward force when being retracted. The internal components have not been detailed since various types of retractable units to retract an elongated member are commonly known in the prior art and may be utilized.

I. Operation of Preferred Embodiment

In use, the vehicle 12 is driven with the ice auger 40 and carriage assembly 30 in the upward position so that the ice auger 40 does not engage the ice surface 16. When a hole location is found, the vehicle 12 is driven to align the blades 46 of the ice auger 40 directly above the desired hole location. The control unit 67 of the motor engaging means is now operated to engage the motor 42 of the ice auger 40 and start rotating of the shaft 45 and blades 46. The control unit 60 of the lifting/lowering means is next engaged to begin to extend the elongated member 63 outwards from the winch 61 and thus lower the carriage assembly 30.

Downward pressure may be additionally applied to the carriage assembly 30 in various manners thus allowing the ice auger 40 to drill through the ice 16 as the ice auger 40 is continually lowered. When the ice auger 40 drills completely through the ice 16, the elongated member 63 is retracted to lift the ice auger 40 out of the drilled hole 17. The motor 42 of the ice auger 40 may be disengaged via the control unit 67 or may be switched to a reverse direction to allow easier removal of the blades 46 from the ice hole 17.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An ice auger attachment system, comprising:

a vehicle;

a support frame attached said vehicle;

a carriage assembly to travel along a vertical axis of said support frame;

a motorized ice auger supported by said carriage assembly in a vertical orientation;

a lifting/lowering means operable from a seat of said vehicle, said lifting/lowering means adapted to lift and lower said carriage assembly and said ice auger;

an auger engaging means operable from said seat of said vehicle, said auger engaging means adapted to engage a motor of said motorized ice auger, wherein said auger engaging means includes a control unit; and a transmission cable connecting said control unit to said motorized ice auger for engaging said motor of said motorized ice auger.

2. The ice auger attachment system of claim 1, including a bracket extending from a lower end of said support frame to connect said support frame to said front end of said vehicle.

3. The ice auger attachment system of claim 2, wherein said bracket is connected to a front grill support of said vehicle.

4. The ice auger attachment system of claim 1, wherein said lifting/lowering means includes:

a winch;

an elongated member retractably extending from said winch;

a pulley connected to an upper end of said support frame;

wherein said elongated member is routed along said pulley and has a terminal end connected to said carriage assembly; and a control unit to operate said winch to extend and retract said elongated member and thus raise and lower said carriage assembly.

5. The ice auger attachment system of claim 4, wherein said winch is comprised of an electric winch.

6. The ice auger attachment system of claim 1, including a means for applying downward pressure connected to said carriage assembly.

7. The ice auger attachment system of claim 6, wherein said means for applying downward pressure is comprised of at least one weighted member connected to said carriage assembly.

8. The ice auger attachment system of claim 6, wherein said means for applying downward pressure is comprised of a retractable unit, wherein said retractable unit is operable from said seat of said vehicle and wherein said retractable unit is connected to said carriage assembly to pull downward upon said carriage assembly.

9. An ice auger attachment for a vehicle, comprising:

a support frame having a pair of first supports and a pair of second supports, both said first supports and said second supports are vertically oriented, said first supports connected to said second supports, and said first supports are connected to a vehicle at a lower end of said first supports; and a carriage assembly having a pair of receiver members, an upper support structure, and a lower support structure, said pair of receiver members slidably connected to said pair of second supports, said upper support structure connected between said pair of receiver members, and said lower support structure extending from a lower end of said upper support structure;

said upper support structure adapted to receive a winching cable for raising and lowering said carriage assembly;

said lower support structure adapted to support a motorized auger therefrom to move up and down with said carriage assembly along said second supports.

10. The ice auger attachment for a vehicle of claim 9, wherein said first supports and said second supports are parallel.

11. The ice auger attachment for a vehicle of claim 9, wherein said support frame includes a plurality of connecting members to connect said first supports to said second supports.

12. The ice auger attachment for a vehicle of claim 11, wherein said first supports are horizontally spaced from said second supports via said connecting members.

13. The ice auger attachment for a vehicle of claim 9, wherein said receiver members are vertically oriented.

14. The ice auger attachment for a vehicle of claim 9, wherein said receiver members are comprised of a square tubular structure.

15. The ice auger attachment for a vehicle of claim 9, wherein said upper structure includes a pair of vertical supports each connected to a respective one of said receiver members and a horizontal support connecting the top ends of said vertical supports.

16. The ice auger attachment for a vehicle of claim 15, wherein said horizontal support includes a looped connector extending upwardly therefrom.

17. The ice auger attachment for a vehicle of claim 9, wherein said lower support structure is oriented within a horizontal plane.

18. The ice auger attachment for a vehicle of claim 17, wherein said lower support structure has a plurality of support members forming a rectangular shape and having an opening extending therebetween.

19. An ice auger attachment system, comprising:

a vehicle;

a support frame attached to said vehicle;

a carriage assembly to travel along a vertical axis of said support frame;

a motorized ice auger supported by said carriage assembly in a vertical orientation;

a winch;

an elongated member retractably extending from said winch;

a pulley connected to an upper end of said support frame;

wherein said elongated member is routed along said pulley and has a terminal end connected to said carriage assembly;

a control unit to operate said winch to extend and retract said elongated member and thus raise and lower said carriage assembly; and an auger engaging means operable from said seat of said vehicle, said auger engaging means adapted to engage a motor of said motorized ice auger.

* * * * *